United States Patent [19]

Nelson

[11] Patent Number: 4,526,532

[45] Date of Patent: Jul. 2, 1985

[54] SELF-IGNITING TORCH

[75] Inventor: John M. Nelson, Brockport, N.Y.

[73] Assignee: Newell Companies, Inc., Freeport, Ill.

[21] Appl. No.: 523,822

[22] Filed: Aug. 15, 1983

[51] Int. Cl.[3] ..... F23Q 7/00

[52] U.S. Cl. ..... 431/255; 431/264; 239/401; 239/579; 251/353; 251/354

[58] Field of Search ..... 431/255, 344, 264, 266, 431/345; 251/353, 340, 339, 354; 239/401, 579, 581, 582

[56] References Cited

U.S. PATENT DOCUMENTS

| | | | |
|---|---|---|---|
| 1,867,934 | 7/1932 | Zahner | 431/265 |
| 2,980,343 | 4/1961 | Hays | 239/579 |
| 3,077,759 | 2/1963 | Gladitz et al. | 239/579 |
| 3,162,238 | 12/1964 | Claywell et al. | 431/266 |
| 3,843,311 | 10/1974 | Nelson | 431/109 |
| 4,013,395 | 3/1977 | Wormser | 431/185 |
| 4,348,172 | 9/1982 | Miller | 431/345 |
| 4,403,946 | 9/1983 | Kagawa | 431/255 |
| 4,428,560 | 1/1984 | Erdelsky | 137/231 |

*Primary Examiner*—Carroll B. Dority, Jr.

*Attorney, Agent, or Firm*—Sprung Horn Kramer & Woods

[57] ABSTRACT

A gas appliance, preferably a torch, is provided with an orifice tube stationary with respect to its housing and receptive of combustible gas and an orifice gas-tightly mounted in the orifice tube for movement along the longitudinal axis of the orifice tube. A burner tube in communication with the orifice tube via the orifice is mounted for slidable movement along the longitudinal axis of the orifice tube in conjunction with the orifice to maintain the relative position of the orifice and burner tube during movement along the orifice tube. A valve in the orifice tube is actuatable in response to the movement of the orifice means in one direction to permit gas to pass into the orifice means and in response to the movement of the orifice means in the opposite direction into a rest position to prevent the flow of gas into the orifice means. An igniter is also responsive to the movement of the orifice to effect a spark in the burner tube to ignite gas permitted to pass by the valve.

26 Claims, 12 Drawing Figures

SELF-IGNITING TORCH

BACKGROUND OF THE INVENTION

The present invention relates to torches and more particularly to self-igniting torches.

Torches which utilize combustible gases, such as propane or Mapp ® gas from a cylinder under pressure, are widely known in the art. Such torches are used for soldering, heating and burning, among other uses. The fuel is generally maintained in a cylinder or other container under pressure, and is released from the cylinder through an adjustable valve passing through a conduit to a burner head. The jet of gas passing out of an orifice is mixed with air to form a combustible mixture ignited in the form of a flame which is used for various purposes. The cylinder is usually remote from the torch head and is generally in the form of a portable hand-held cylinder with the torch head and valve mounted directly thereon. This type of portable torch and cylinder constitute generally the disposable liquid propane gas cylinder type that is widely used. Torches such as those described above are disclosed in U.S. Pat. Nos. 3,612,037; 3,994,674 and 4,332,550.

Known torch head assemblies conventionally have a valve body including an adjustable needle stem and a tube leading from the valve housing with a gas orifice or spud disposed in the tube considerably spaced from the valve housing and followed by air holes wherein the gas is mixed with air and thereafter proceeds to a flameholder at the other end of the tube. A flameholder is shown in U.S. Pat. No. 4,013,395 as item 116.

One disadvantage of many torches is the need for ignition by an external spark generator such as a hand-held friction device and this problem has been addressed to some extent in U.S. Pat. No. 4,013,395 which concerns an aerodynamic fuel combuster, showing a spark generator 17 which activates a spark plug 15 when pushbutton 19 is depressed and U.S. Pat. No. 3,843,311 which describes a piezoelectric device for igniting a lantern wherein piezoelectric element is activated when resilient member 68 is depressed.

However, in self-ignitable torches problems could arise in conjunction with the location of ignition devices, e.g., ignition wires, retaining clips, venturis etc., upstream of the flameholder. Such ignition wires and retainer clips could result in burning not only downstream of the flameholder, but also between the orifice and the flameholder. This could result in severe overheating of the burner tube and a reduction in combustion intensity.

SUMMARY OF THE INVENTION

The main object of the present invention is to provide a convenient and safe self-igniting torch.

Another object of the present invention is to provide a torch having a reciprocating orifice which moves in response to initiating self-ignition to open a valve to allow combustible gas to flow through the orifice. Still another object of the present invention is to use the reciprocating orifice in combination with a reciprocating burner tube to maintain the positioning of the orifice outlet relative to the air entrainment holes of the burner tube.

A further object of the present invention is to effect ignition by inserting a lead wire of the ignition circuit at a low pressure area in the burner tube so as to eliminate the need to seal the lead wire entrance which would be necessary if the lead wire entered the burner tube at a high pressure area, e.g., near the spark gap of the ignition circuit.

A still further object of the present invention is to provide an improved ignition geometry for the flameholder and ignition system to prevent flameholding by the clips, wires, venturis, etc. upstream of the flameholder.

Another object of the present invention is to provide a self-ignitable torch that is convenient for an adult while difficult for a child to operate.

A further object of the present invention is to provide a self-igniting torch having an additional fuel line to inject raw fuel into the primary flame, to produce a small, highly portable flamethrower.

A still further object of the present invention is to provide a torch design which is capable of being used with a directly connected gas cylinder or with a remote source of gas via a hose, with only minor design modifications.

These and other objects of the present invention are achieved in accordance with the present invention, in a gas appliance, preferably a torch, having a housing and means connectable to a source of combustible gas, wherein an orifice tube, stationary with respect to the housing, is receptive of gas from said means connectable to a gas source and orifice means is gas-tightly mounted in the orifice tube for movement along the longitudinal axis of the orifice tube.

A burner tube is preferably in communication with the orifice tube via the orifice means and mounted for slidable movement along the longitudinal axis of the orifice tube and means are provided for moving the burner tube in conjunction with the orifice means to maintain the relative position of the orifice means and burner tube during movement along the orifice tube.

Valve menas are also preferably provided in the orifice tube and actuatable in response to the movement of the orifice means in one direction to permit gas to pass into the orifice means and in response to the movement of the orifice means in the opposite direction into a rest position to prevent the flow of gas into the orifice means.

The gas appliance also preferably has means for igniting the gas in the burner tube including means which is responsive to the movement of the orifice means and thereby the burner tube in the one direction for effecting a spark in the burner tube.

In another preferred embodiment, a gas appliance has means connectable to a source of combustible gas, orifice means in communication with the means connectable to a source of gas and having an orifice opening at one end thereof, a burner tube receptive of the output from the orifice opening and having at least one air hole therein in the vicinity of the orifice opening, venturi means downstream of the air hole in the burner tube for producing a low pressure gas region to entrain ambient air and ignition means for igniting gas in the high pressure region including an ignition wire extending from externally of the burner tube to within the burner tube and inserted through the burner tube at the low pressure region thereof.

The gas appliance preferably has a flameholder in the burner tube downstream of the venturi means and wherein the ignition means includes means forming a spark gap including said ignition wire which includes a portion internally of the burner tube extending approximately parallel to the burner tube axis, and a free end forming one side of the spark gap and a clip holding the free end in place upstream of the flameholder.

The gas appliance preferably has the stationary orifice tube and the orifice means gas-tightly mounted therein for movement along the longitudinal axis of the orifice tube and the burner tube mounted for slidable movement along the longitudinal axis of the orifice tube with the burner tube and the orifice means maintaining their relative position during movement along the orifice tube.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

DETAILED DESCRIPTION OF THE INVENTION

Figure 1:
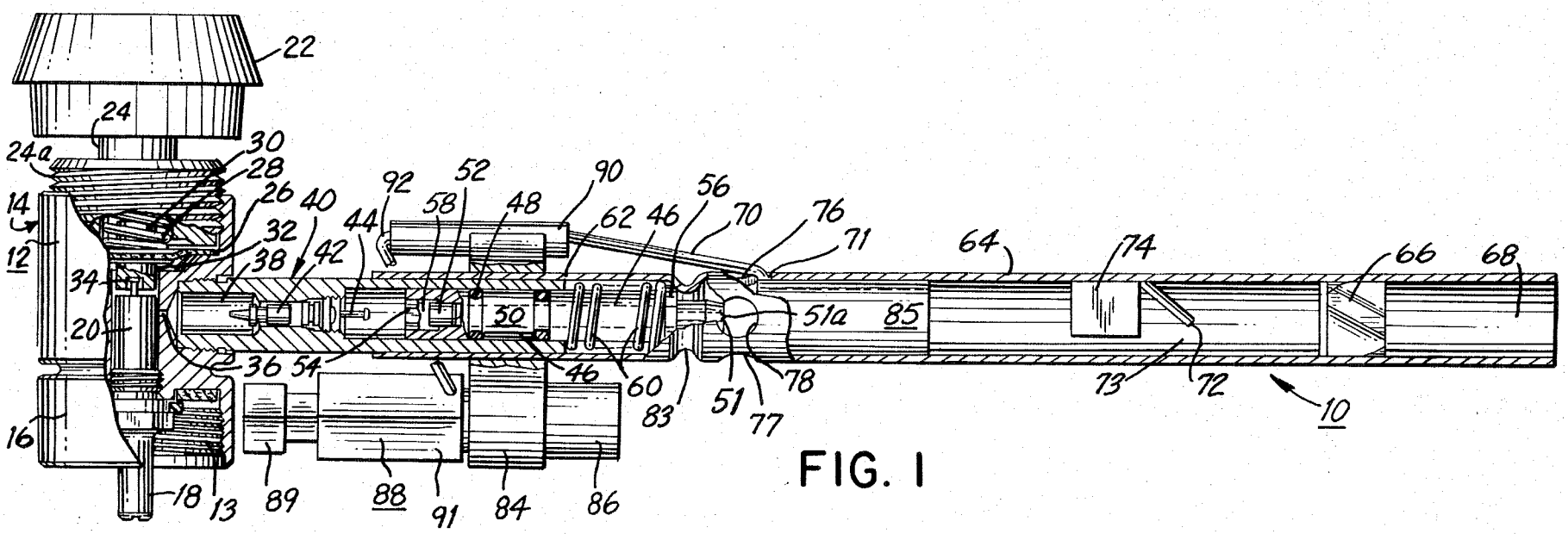
FIG. 1 is a partial sectional elevational view showing a torch according to the present invention.

Referring to the drawings in detail, wherein like numerals indicate like elements there is shown in FIG. 1 a torch 10 in accordance with the present invention. The torch 10, in the embodiment shown includes valve housing 12 a needle (or regulating) valve 14 such as disclosed in U.S. Pat. No. 3,075,739. The valve housing 12 can be fabricated from any suitable material such as brass.

A tap connector section 16 of the valve housing 12 has a cylindrical recess with internal female threads 13 for connection with a combustible fluid supply, such as a portable dispensible gas cylinder (not shown). An example of one such gas cylinder is sold under the trade name "Bernzomatic" cylinder. Gas contained in such cylinder can be, for example, propane or Mapp® gas. The preferable cylinder would have corresponding male threads to mate wih the female threads 13 of the tap connector section 16. The tap connector section 16 has a valve member 18 for extension into the discharge opening of the cylinder to press on the cylinder closure valve (not shown) which is conventionally a "tire" valve and thereby open the cylinder for discharge of gas into the valve member 18.

Gas passes through valve member 18 into valve chamber 20. Rotational movement of valve knob 22 translates into longitudinal movement of valve stem 24 which has a threaded portion (not shown) which mates with a threaded portion (not shown) of a valve cap 24*a*. Spring 28 is held in place adjacent valve diaphragm 26 by stem 24. As the knob 22 is turned, the valve stem 24 moves up and down. When the valve stem 24 moves downwardly it pushes against spring 28 which in turn bears on plate 30 which pushes valve diaphragm 26 onto plate 32. Valve plate 32 forces valve pin 34 to move downwardly thus controlling the flow of gas from chamber 20 into valve outlet 36 and chamber 38 of orifice tube 40.

Orifice tube 40, preferably made of brass, is gas-tightly connected substantially perpendicular to valve housing 12 and has valve core 42 disposed therein. Valve core 42 is seated in orifice tube 40 and is actuated when valve stem 44 is moved to the left by core driver 54 of orifice 46.

Orifice 46 is disposed in orifice tube 40 with O-ring seal 48 sealing the orifice 46 against the inner surface of orifice tube 40. The orifice 46 has an internal fluid passage 50 having an internal filter 52 therein. At one end of the orifice 46 is core driver 54 which has a hexagonal cross-section and is disposed in a circular opening 58 so as to form six apertures (not shown) between the points where the vertices meet the circumference of the opening 58. Passage 50 terminates at end 51 of orifice 50 with a small aperture 51*a*.

The orifice 46 has an external collar 56 against which a compression spring 60 rests with the other end of spring 60 bearing against the end 62 of the orifice tube 40. Orifice 46 is slidably mounted in orifice tube 40 to move from the position shown in FIG. 1, to the left wherein the core driver 54 actuates the valve stem 44. Spring 60 normally biases orifice 46 into the position shown in FIG. 1.

A burner tube 64 is slidably engageable over the orifice tube 40. The burner tube 64 is fabricated from a suitable metal material such as steel. Burner tube 64 encloses that part of the orifice 46 which extends outwardly from the end 62 of orifice tube 40.

Figure 1A:
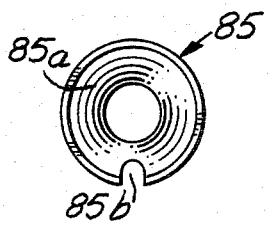
FIGS. 1A and 1B are side and sectional views of the venturi shown in FIG. 1.
Figure 1B:
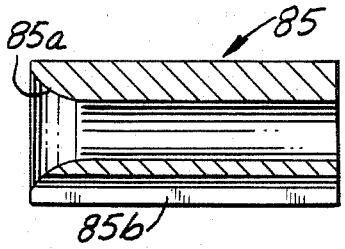
Figure 1C:
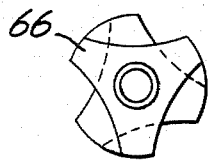
FIG. 1C is a front view of the flameholder shown in FIG. 1.

Burner tube 64 has a corset 83 at the end facing the orifice 46 and which bears on collar 56. To the right of corset 83 are air holes 76–79 at approximately the position of aperture 51*a* of orifice 46. Just downstream of air holes 76–79 is venturi 85, preferably made of steel, and forming a venturi passage 82 therein. FIGS. 1A and 1B shows the venturi in more detail wherein the venturi 85 includes a rounded upstream portion 85*a* and a wire passage 85*b*. Downstream of the venturi 85 is flameholder 66, preferably made of brass, which is shown in more detail in FIG. 1C.

Figure 5:
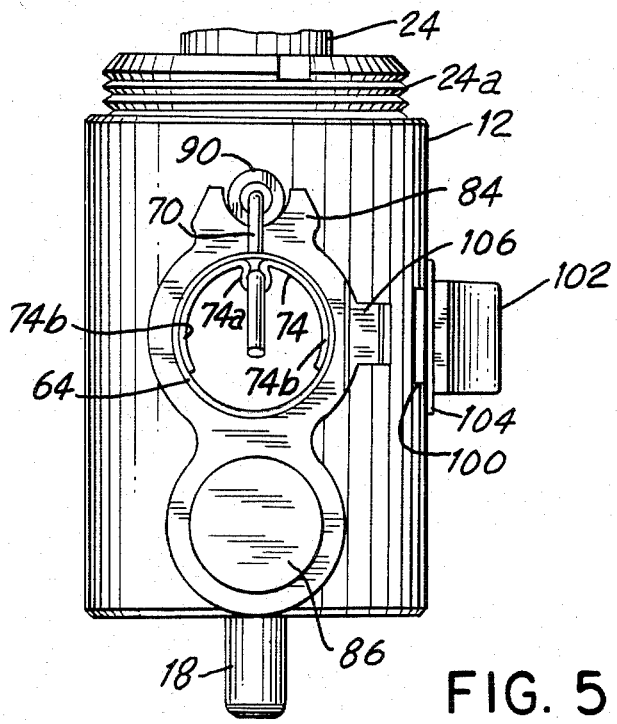
FIG. 5 is a partial front view thereof of the torch shown in FIG. 3, with the flameholder and cover removed.

The self-ignition system includes a lead wire 70 which enters the burner tube 64 through an extension slot 71 in air hole 76 (see FIG. 2) and runs through wire passage 85*b* in venturi 85 parallel to the central axis of the burner tube 64 and it is held in place by retainer clip 74 shown in more detail in FIG. 5. Retainer clip 74 has a central wire holding portion 74*a* and two arcuate arms 74*b* which bear against the inner surface of burner tube 64.

The lead wire 70 is shown entering the burner tube 64 in FIG. 1 through air hole 76. However, the lead wire may be inserted through the burner tube at another position, although less preferable, as long as it is a low pressure location. Insertion of the lead wire 70 in a low pressure location eliminates the need to seal the lead wide entrance 71, which would be necessary if the lead wire 70 entered at a high pressure area; e.g., near spark gap 73.

As shown in FIG. 1, the spark gap 73 is formed between an exposed end 72 of the lead wire 70 and the inner surface of the burner tube 64. This arrangement presupposes an electrically conductive burner tube 64 and eliminates the need for a second lead wire. The spark gap can also be effected by using two lead wires separated by a gap or by using other spark generating means.

It is known to those skilled in the art, that if an ignition source is applied to a combustible mixture flowing in a simple tube, a stationary flame front (defined as the most upstream surface of the flame of combusted fuel) will result only when the mixture speed and the flame speed of the mixture are identical. If the mixture is moving faster or slower than the flame speed, the flame will blow out or backfire, respectively. Since the fuels commonly used in air inspirated torches possess relatively low flame speeds, which results in relatively low combustion intensities, and since it would be very difficult to design a practical torch that operated with a very narrow throughput range, flameholders are universally used to increase both the minimum throughput and the throughput range. By generating bluff body turbulence and/or reverse or swirl flow, flameholders act to increase the residence time of the mixture downstream of the flameholder. It should be noted that any obstruction in a flow stream offers some turbulent flameholding, but that only specific designs afford efficient flameholding, such as that disclosed in U.S. Pat. No. 4,013,395, which is the type used in the present invention.

During the design of the present invention it was found that burning would occur not only downstream of the flameholder 66, but also between the retaining clip 74 and the flameholder 66. This caused severe overheating of the burner tube and a reduction in combustion intensity. Because a clip is not capable of holding a high intensity flame, it was initially assumed that the problem involved a boundary effect due to upstream ignition. However, it was surprisingly discovered that the lead wire and clip combination and the flameholder were acting synergistically, that is, the flameholding ability of the clip 74 was enhanced by the flameholder 66. The geometry of the lead wire 70 and clip 74 was modified to obtain the disclosed configuration to prevent undesired flameholding.

Therefore, in a torch ignited upstream of the flameholder and in which the lead wire is approximately parallel to the burner tube axis for at least a short distance, it has been found that the synergistic and detrimental effects described above can be prevented if, at any cross section perpendicular to the axis of an imaginary rectangular solid defined below, the total projected area of the lead wire 70, electrode, if any, the lead wire or electrode supports 74, if any, and all other obstructions to flow, if any which includes air entrainment means such as venturi 85 and flameholder 66, does not exceed 25% of the burner tube cross sectional area, wherein the imaginary rectangular solid is a right circular cylinder having its center of mass coinciding with the end of the lead wire or electrode, its radius equal to one spark gap width, its axis parallel to the burner tube axis, and its length equal to six spark gap widths.

Air holes 78 and 79 are disposed 90° on either side from air hole 76 and air hole 77 is located 180° from air hole 76. One skilled in the art will clearly understand that although four air holes are shown in the preferred embodiment, the present invention can be carried out with any number of air holes.

The ignition system further comprises a trigger base 84 rigidly mounted on burner tube 64 and which supports a trigger 86 having a biased piezoelectric igniter 88 disposed on the rear surface of trigger 86 and having a plunger 89 facing valve body 12. Lead wire 70 is connected to wire 92 via the wire connector 90 and wire 92 is in turn connected to the piezoelectric igniter 88 which is a two terminal device and which has its other terminal connected to the burner tube 64 via base 84. The piezoelectric igniter 88 is composed of the burner 89 which is spring biased into position and is slidably mounted for axial movement. The igniter is mechanically activated, that is, pulling trigger 86 forces plunger 89 against valve housing 12. The depression of plunger 89 creates an electrical voltage across spark gap with current running through the ignition circuit including wires 92 and 71, spark gap 73 (forming an ignition spark), to burner tube 64, to base 84 and back to igniter 88. The igniter, for example, can be a Panasonic EFI-ML 28 igniter.

In use, after the torch 10 is attached to a fuel cylinder, the valve 14 is opened by turning knob 22 which allows gas to enter the orifice tube 40 where it is prevented from passing by the valve core 42. Pulling the trigger 86 moves the burner tube 64 toward the valve 14, and since the burner tube corset 83 bears on the orifice collar 56, the orifice 46 also moves. When the core driver 54 begins to open the tire valve 42, via valve stem 44 fuel passes through the filter 52 and passage and exits the orifice via opening 51*a* of the orifice 46. By entrainment and the venturi pressure drop, air is induced into the fuel stream via air holes 76–79 and the ignitable mixture escapes to the atmosphere.

Continued movement of trigger 86 forces plunger 89 of igniter 88 against the valve housing 12 actuating the igniter 88 in an impulse-like manner to generate sufficient voltage to create a spark in the gap 73 formed by the exposed end 72 of lead wire 70 and the inside of the burner tube 64. This spark generates a small kernal of flame which grows rapidly as it travels downstream, and anchoring to the downstream side of the flameholder 66, produces a steady flame.

To maintain the flame, the tire valve 42 must be maintained open and therefore the load on the trigger 86 must be maintained. To avoid having the user maintain the force on the trigger 86, a locking mechanism is provided including spring member 94 connected to valve body 12 by rivet 96. Member 94 has button 102 projecting therefrom and locking aperture 104 therein which is engageable with latch member 106 on the base 84.

Figure 2:
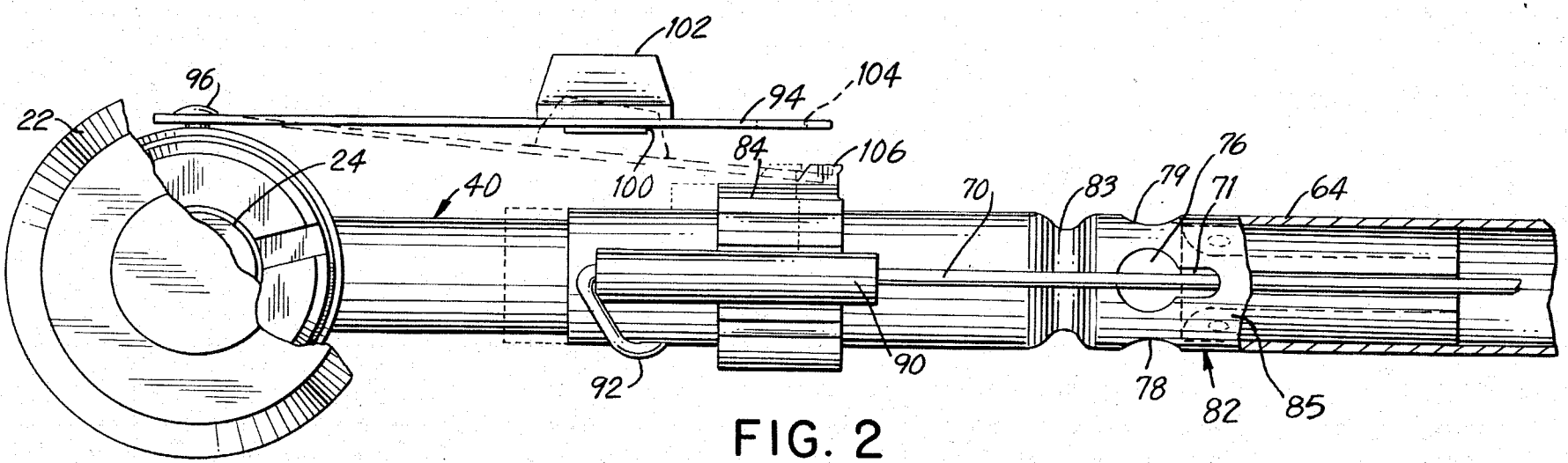
FIG. 2 is a partial top plan view of the torch shown in FIG. 1.

In order to engage the locking mechanism, upon pulling trigger 86 to effect self-ignition, the trigger 86, base 84, latch member 106, burner tube 64 and orifice 46 will be in the position shown in dotted lines in FIG. 2. At that point, the torch will be ignited and by pushing button 102 (downwardly in FIG. 2), latch member 106 will engage locking aperture 104. Upon releasing the trigger, the combined forces of the return spring 60, the igniter 88 return spring (not shown) and the gas pressure-area force on the orifice 46 advance the burner tube 64, and the trigger base slot 104 engages the latch member 106. The locking mechanism is released simply by pulling back on the trigger 86 to disengage latch member 106 from locking aperture 104 causing the spring member 94 to return to its rest position shown in solid lines in FIG. 2. Releasing the load on the trigger 86, permits the burner tube 64 and orifice 46 to advance to their position shown in FIG. 1 due to the action of spring 60.

As can be seen from the above explanation, the orifice 46, in a unique construction reciprocates to actuate valve 42. Moreover, the burner tube 64 is advantageously mounted to reciprocate with orifice 46 so that both move together when the trigger 86 is pulled, the relative position of the orifice opening 51*a*, adjacent the air holes 76–79 remaining constant.

Figure 4A:
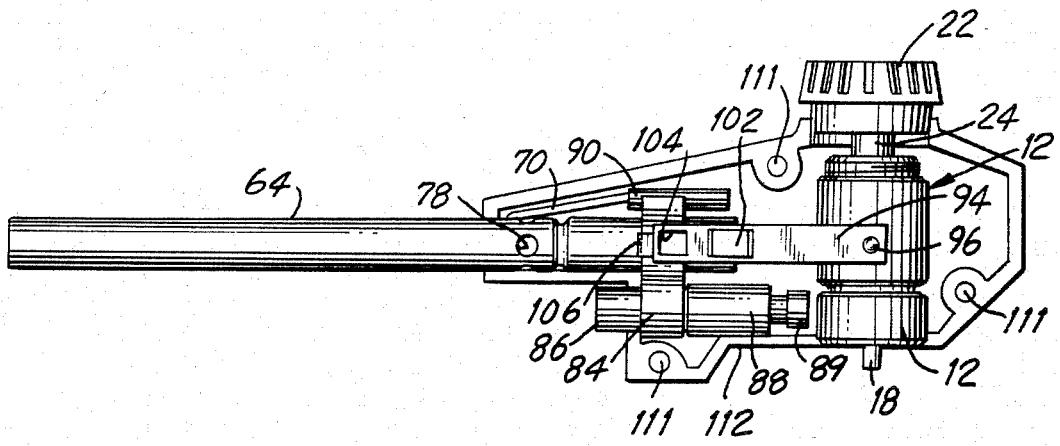
FIG. 4A shows the torch of FIG. 4 with half of the cover removed.
Figure 3:
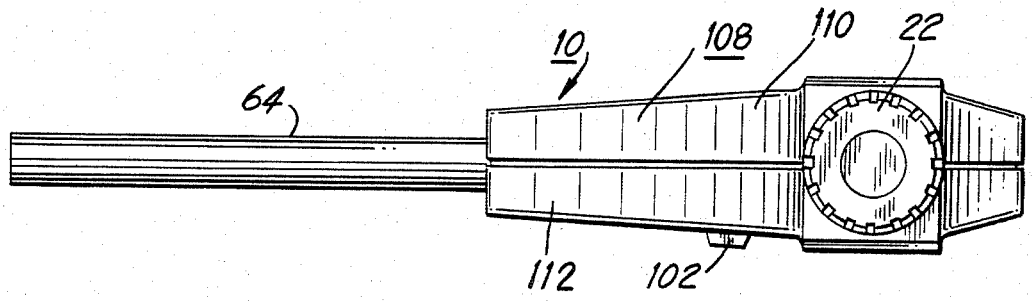
FIG. 3 is a top view showing the torch of the present invention.
Figure 4:
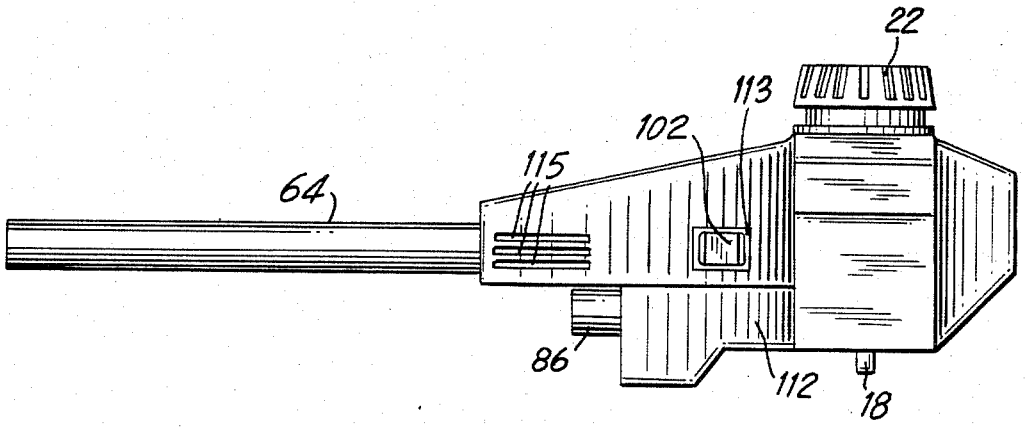
FIG. 4 is a side view of the torch shown in FIG. 3.

Referring to FIGS. 3, 4 and 4A, a cover 108 is provided for the torch. Cover 108 is constructed from a suitable material such as a durable plastic, i.e. cycolac. The cover 108 is composed of two halves, 110 and 112 held together by screws in screw holes 111.

The cover 108 encloses most of the torch 10, only portions of the knob 22, trigger 86, burner tube 64, valve member 18 and lock button 102 are exposed. Button 102 is exposed through aperture 113 in cover half 112. Moreover, both halves 110 and 112 include vent holes 115 which allow air to enter air holes 76–79 in burner tube 64, the air holes 76–79 being otherwise enclosed by cover 110 in any axial position of the burner tube. As can be seen from FIG. 4A, the assembled cover 108 floats slightly in all directions to preclude binding of the torch 10, however, it effectively prevents undesirable torch 10 excursions, including excessive rotation about the burner tube 64 center line axis which would defeat the ignition and locking mechanisms, and excessive forward motion which would result in torch 10 assembly disengagement.

The trigger 86 and cover 108 are also advantageously designed so that the distance between the trigger 86 and the rear of the cover is too great to readily accommodate a child's hand and creates a long pull for actuation. Thus the self-igniting feature is usable by an adult and inconvenient for a child. Moreover, the torch can be made more difficult for a child to use by increasing the force necessary to pull the trigger, i.e., by providing a stiffer spring 60.

Figure 6:
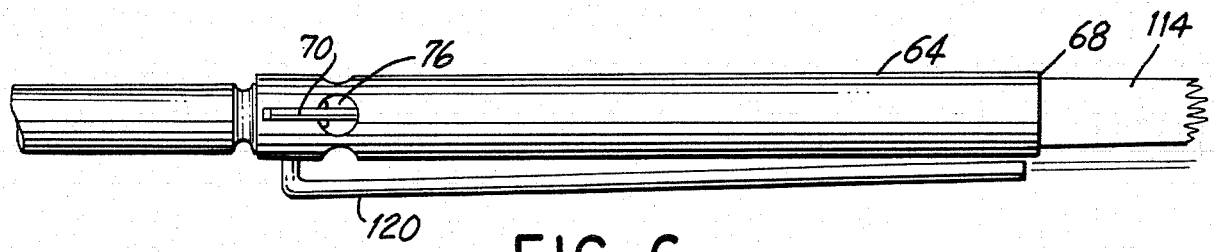
FIG. 6 shows a top plan view of a burner tube of another embodiment of a torch according to the present invention.
Figure 7:
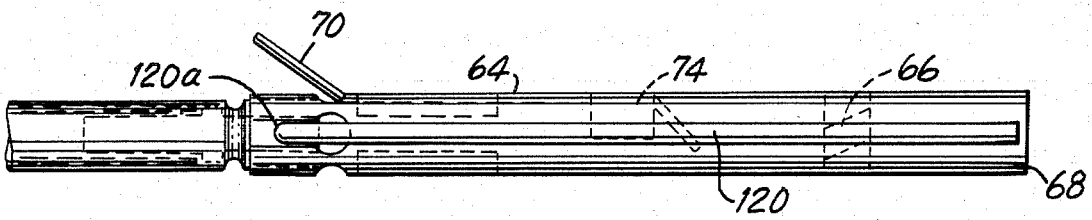
FIG. 7 is a side view of the burner tube shown in FIG. 6.

Another embodiment of a torch according to the present invention is depicted in FIG. 6 and FIG. 7 in which a secondary fuel tube 120 is provided which extends outside and runs substantially parallel to the burner tube 64. The secondary fuel tube 120 terminates at the burner tip 68 to deliver a combustible fluid, such as propane gas, to the flame 114. The burner tube 64 is slotted at 120*a* to permit the secondary fuel tube 120 to pass through while also allowing for ease of assembly. The propane tube 120 is connected with the orifice 46 upstream of opening 51*a* and reciprocates with the orifice 46 and burner tube 64.

The output of such a torch having a secondary fuel tube 120 can be varied over an extremely wide range and over a very wide range of mixtures; i.e., the torch can operate with a slightly rich (blue) to an extremely rich (yellow) flame. Outputs of 200,000 plus BTU per hour yield a small, highly portable flamethrower, and potential applications are numerous, including firefighting training and the lighting of backfires.

Figure 8:
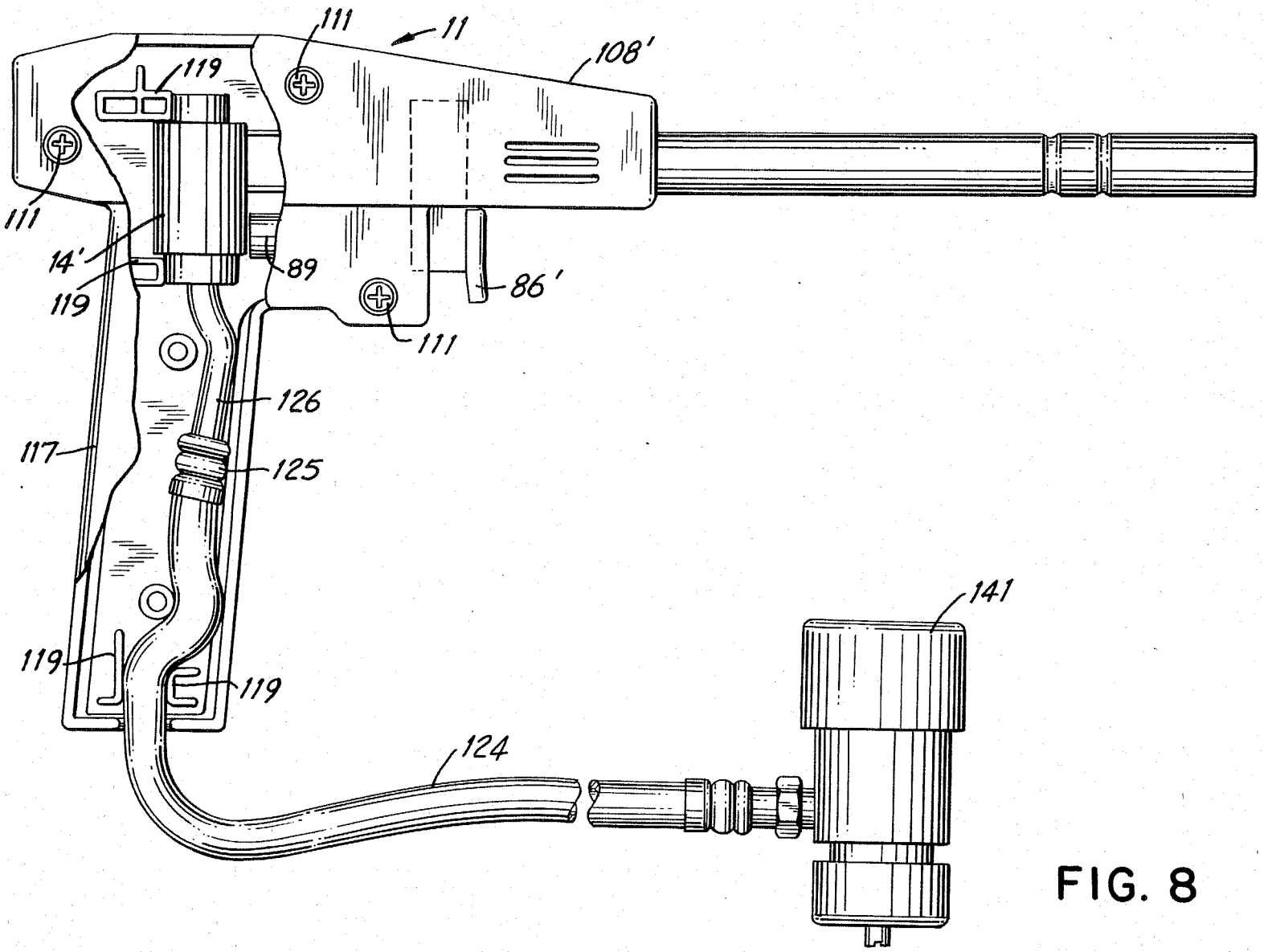
FIG. 8 is a side elevational and partly sectional view of another embodiment of a torch according to the present invention.

FIG. 8 depicts an alternative embodiment of a torch 10' according to the present invention wherein a remote gas source is used, whose fitting 14' is connected to the torch 10' by a hose 124. The hose torch 10' takes some of the weight out of the user's hands by eliminating the tank.

The cover 108' herein is constructed from two halves and includes a handle portion 117 into which hose 124 is received and which is connected via ferrule 125 and connector 126 to fitting 14' into which orifice tube 40 is connected and against which plunger 89 is pressed. The cover 108' also has integral guide pieces 119 which enable the elements shown to be held in place without binding. The trigger 86' is also modified herein to be larger for easier operation.

It will be appreciated that the instant specification and claims are set forth by way of illustration and not limitation, and that various modifications and changes may be made without departing from the spirit and scope of the present invention.

What is claimed is:

1. A torch comprising: a housing; an orifice tube mounted in the housing and stationary with respect thereto and receptive at one end of a source of combustible fluid; normally closed valve means disposed in the orifice tube; orifice means slidably disposed in said orifice tube through the other end thereof for opening the valve upon movement towards said one and of the orifice tube; means biasing said orifice means away from the valve means; a burner tube slidably engaged at one end thereof on the orifice tube; means mounting the burner tube for movement with the orifice means; and means for manually moving the orifice means against the action of the biasing means to open said normally closed valve means.

2. A torch according to claim 1, wherein said orifice means has an outlet opening and said burner tube has at least one air hole therethrough adjacent said outlet opening.

3. A torch according to claim 1, wherein said housing comprises handle means attached substantially perpendicularly to said orifice tube.

4. A torch according to claim 1, wherein the means for manually moving comprises a trigger attached to the burner tube.

5. A torch according to claim 1, further comprising a flow control valve upstream of the orifice tube and receptive of a source of combustible fluid.

6. A torch according to claim 1, further comprising means gas-tightly sealing the outer surface of said orifice means with respect to the inner surface of said orifice tube.

7. A torch according to claim 6, wherein said sealing means comprises an O-ring.

8. A torch according to claim 1, wherein said biasing means comprises a compression spring.

9. A torch according to claim 1, further comprising ignition means for igniting gas in said burner tube.

10. A torch according to claim 9, wherein said ignition means comprises a spark gap and an electrically conductive lead wire extending into the burner tube and having a free end forming one side of the gap.

11. A torch according to claim 10, further comprising venturi means in the burner tube downstream of the air holes and upstream of the spark gap and a flameholder disposed in said burner tube downstream of the spark gap.

12. A torch according to claim 11, further comprising a retainer clip holding the lead wire in place.

13. A torch according to claim 1, wherein said ignition means comprises piezoelectric element.

14. A torch according to claim 1, further comprising a secondary fuel tube having an inlet connected to the orifice means and an outlet adjacent the end of the burner tube.

15. A torch according to claim 12, wherein said wire enters the burner tube and has a portion which extends substantially parallel to the burner tube axis and internally of the burner.

16. A torch according to claim 4, further comprising means for releasably locking the trigger in a position wherein the orifice means opens said valve means.

17. A torch according to claim 16, wherein said locking means comprises a latching projection movable with the trigger and a resilient member having a latching aperture therein and movable from a rest position spaced from the latching projection to an locking position wherein the latching aperture is engaged by the latching projection.

18. In a gas appliance having a housing and means connectable to a source of combustible gas, the improvement comprising: a first tube receptive of gas from said means connectable to a gas source and stationary with respect to the housing; orifice means gas-tightly mounted in the first tube for movement along the longitudinal axis of the first tube; valve means disposed in the first tube upstream of the orifice means and actuatable in response to the movement of the orifice means in one direction into an open position to permit gas to pass into the orifice means and in response to the movement of the orifice means in the opposite direction into a closed position to prevent the flow of gas into the orifice means; a second tube in gas communication with the first tube via the orifice means and mounted on the outside of said first tube for slidable movement along the longitudinal axis of the first tube; and means for moving the second tube in conjunction with the orifice means to maintain the relative position of the orifice means and second tube during the movement thereof along the first tube.

19. The gas appliance according to claim 18, further comprising means for igniting the gas in the second tube including means responsive to movement of the orifice means and thereby the second tube in the one direction for effecting a spark in the second tube.

20. In a gas appliance having a housing and means connectable to a source of combustible gas, the improvement comprising: a first tube receptive of gas from said means connectable to a gas source and stationary with respect to the housing; orifice means gas-tightly mounted in the first tube for movement along the longitudinal axis of the first tube; valve means disposed in the first tube and actuatable in response to the movement of the orifice means in one direction along the longitudinal axis of the first tube into an open position to permit gas to pass into the orifice means and in response to the movement of the orifice means in the opposite direction into a closed position to prevent the flow of gas into the orifice means; and means for igniting the gas downstream of the orifice means including means responsive to movement of the orifice means in the one direction for effecting a spark.

21. A torch having means connectable to a source of combustible gas, orifice means in gas communication with the means connectable to a source of gas and having an orifice opening at one end thereof, one tube receptive of the output from the orifice opening and having at least one air opening therein in the vicinity of the orifice opening, whereby in the vicinity of the air opening in the one tube, a relatively lower pressure gas region than ambient atmospheric pressure is produced for entrainment of ambient air, and ignition means for igniting gas downstream of the lower pressure region and at a desired location in the one tube and including electrically conductive means extending from externally of the one tube to within the one tube upstream of the desired location at the lower pressure region of the one tube and for conducting electrical energy to said desired location in the one tube.

22. The torch according to claim 21, further comprising flame-holding means in the one tube downstream of the air opening and wherein the electrically conductive means includes means forming a spark gap at said desired location including an ignition wire having a portion internally of the one tube and extending approximately parallel to the one tube axis, and a free end forming one side of the spark gap and means holding the free end in place upstream of the flame-holding means.

23. The torch according to claim 21, further comprising a housing, said orifice means including another tube receptive of gas from said means connectable to a gas source and stationary with respect to the housing and means gas-tightly mounting an orifice member therein for movement along the longitudinal axis of said another tube.

24. The torch according to claim 23, further comprising means mounting the one tube for slidable movement along the longitudinal axis of said another tube and means for moving the one tube in conjunction with the orifice means to maintain the relative position of the orifice means and one tube during movement along said another tube.

25. The torch according to claim 23, further comprising valve means actuatable in response to the movement of the orifice means for permitting and preventing gas to flow to the one tube.

26. The torch according to claim 21, further comprising a secondary fuel tube having an outlet adjacent the end of the one tube.

* * * * *